US007156577B1

(12) United States Patent
Rozinski

(10) Patent No.: US 7,156,577 B1
(45) Date of Patent: Jan. 2, 2007

(54) CONCRETE FINISHING TOOL WITH HANDLE-MOUNTED VIBRATING ARRANGEMENT

(76) Inventor: Richard M. Rozinski, 1504 E. 43rd Ave., Kenosha, WI (US) 53144

( * ) Notice: Subject to any disclaimer, the term of this patent is extended or adjusted under 35 U.S.C. 154(b) by 0 days.

(21) Appl. No.: 11/441,665

(22) Filed: May 26, 2006

Related U.S. Application Data

(60) Provisional application No. 60/686,509, filed on Jun. 1, 2005.

(51) Int. Cl.
*E01C 19/38* (2006.01)

(52) U.S. Cl. ..... 404/114

(58) Field of Classification Search ..... 404/114, 404/118

See application file for complete search history.

(56) References Cited

U.S. PATENT DOCUMENTS

| | | | | |
|---|---|---|---|---|
| 3,067,656 | A | 12/1962 | Gustafson | |
| 4,650,366 | A | 3/1987 | Morrison | |
| 5,244,305 | A | 9/1993 | Lindley | |
| 5,375,942 | A | 12/1994 | Lindley et al. | |
| 5,540,519 | A | 7/1996 | Weber | |
| 5,857,803 | A | 1/1999 | Davis et al. | |
| 6,089,787 | A * | 7/2000 | Allen et al. | 404/118 |
| 6,139,217 | A | 10/2000 | Reuter | |
| 6,200,065 | B1 | 3/2001 | Eitzen | |
| 6,231,331 | B1 | 5/2001 | Lievers | |
| 6,293,780 | B1 * | 9/2001 | Rijkers | 425/456 |
| 6,296,467 | B1 | 10/2001 | Rouillard | |
| 6,322,286 | B1 | 11/2001 | Rijkers | |
| 6,705,799 | B1 | 3/2004 | Piccoli | |
| 6,780,369 | B1 | 8/2004 | Darrow et al. | |
| 6,988,851 | B1 * | 1/2006 | Sina | 404/114 |
| 7,052,204 | B1 * | 5/2006 | Lutz | 404/118 |

* cited by examiner

*Primary Examiner*—Gary S. Hartmann
(74) *Attorney, Agent, or Firm*—Andrus, Sceales, Starke & Sawall, LLP

(57) ABSTRACT

A vibratory concrete finishing tool includes an elongated handle formed with a cylindrical configuration having an uppermost end and a lowermost end. A concrete working device has a planar bottom surface adapted to engage a wet concrete surface, and a receiver for removably receiving the lowermost end of the handle. A clamping and vibration transmitting arrangement is coupled externally to the lowermost end of the handle. An engine-driven vibratory mechanism is fixed to the clamping and vibration transmitting arrangement so that the vibratory mechanism is held in spaced relationship with the handle. The vibratory mechanism has a spinning crankshaft assembly with an eccentric weight mounted thereon.

15 Claims, 4 Drawing Sheets

CONCRETE FINISHING TOOL WITH HANDLE-MOUNTED VIBRATING ARRANGEMENT

CROSS REFERENCE TO RELATED APPLICATION

This application relates to and claims priority based on U.S. Provisional Patent Application Ser. No. 60/686,509 filed Jun. 1, 2005.

FIELD OF THE INVENTION

The present invention relates generally to tools employed in the finishing of wet concrete and, more particularly, pertains to a concrete finishing tool provided with a vibrating arrangement specifically mounted and positioned on an elongated handle of the finishing tool.

BACKGROUND OF THE INVENTION

In the course of constructing concrete slabs and the like, liquefied concrete comprised of aggregate, cement, water and other additives is freshly poured into a form and must first be brought to a desired shape and size of the slab. This is conventionally done by screeding or striking off (i.e. spreading, distributing and leveling) the uncured concrete usually with the use of prepositioned guides or rails. Typical screeding or striking methods include manually passing the edge of a two by four plank across the poured concrete as well as using powered vibratory screed devices. Much effort and time is taken by laborers during the screeding or striking process to achieve an initial flatness of the poured concrete.

Following the striking off process, the stiff fresh concrete is next worked by using a float or similar device to provide a smooth, homogenous mixture. Floating the concrete enables further settling the concrete aggregate in the poured mass and permits densifying and compacting the viscous mixture. Floating also helps remove air voids and gaps caused by the striking process and brings excess water and fine aggregates to the surface for subsequent finishing. Floating serves the purpose of driving the suspended gravel downwards, and developing a wetted surface layer or cream/paste composed of fine particles (sand, cement, fly ash) and water which is conducive to filling in the voids and gaps and preparing the surfaces for final finishing.

A bull float is most often used for the floating process in compacting and smoothing the concrete. The bull float is a working device in the form of a large rectangular plate or blade of magnesium or aluminum which is coupled to an elongated, cylindrical handle for pushing and/or pulling the plate over the top surface of the concrete. If there are spots on the slab from poor striking or low slump mixes, the bull float is shaken vigorously across those spots to achieve flatness and fill in the voids. When bull floating is done manually, it is extremely labor intensive and much strain is felt upon the operator's body.

The floating can be accompanied by some sort of a vibration of the concrete to expedite the finishing process. In one type of device, a vibrating mechanism is placed inside the elongated handle of the float tool as well as on the bull float itself. An inherent consequence of this device is that the handle vibrates as much or more than the plate of the bull float. Other devices solely employ vibrating units spaced along the upper surface of the bull float plate, but this limits the versatility of the finishing tool. In older devices, the provision of the vibratory units on the bull float surface created a heavy finishing tool which could sink into the concrete causing depressions in the surface.

Accordingly, it is desirable to provide a more versatile vibratory concrete finishing tool which will alleviate the shortcomings and problems of prior art devices. It is also desirable to provide a concrete finishing tool which will transmit vibrational energy to the working device attached to the elongated handle. It is further desirable to provide a concrete finishing tool which will provide vibrational energy to a variety of working devices attached to the elongated handle. Moreover, it is desirable to provide a vibratory concrete finishing tool having a weight which will not cause depressions in the surface of the wet concrete.

SUMMARY OF THE INVENTION

It is a general object of the present invention to provide an improved tool for finishing the surface of freshly poured concrete using a vibratory planning device.

It is one object of the present invention to provide a concrete finishing tool having a vibrating mechanism coupled to the working end of an elongated, cylindrical handle.

It also is an object of the present invention to provide a vibratory concrete finishing tool effective in creating a smooth, wet cream/paste on the top of the layer of the wet concrete for lubrication of a tool, and filling in the gaps and voids caused by striking and creating a smooth finish of the concrete.

It is a further object of the present invention to provide a unique clamping and vibration transmitting arrangement for a vibrating concrete finishing tool.

It is an additional object of the present invention to provide a vibratory concrete finishing tool which reduces the amount of striking and floating required in the finishing of concrete.

It is another object of the present invention to provide for externally mounting a vibratory mechanism on an elongated handle that is coupled to various concrete working devices.

Still another object of the present invention is to provide a concrete finishing tool which is available at a reasonable economic cost to the concrete finishing industry.

In one aspect of the invention, a vibratory concrete finishing tool includes an elongated handle formed with a cylindrical configuration having an uppermost end and a lowermost end. A concrete working device has a planar surface adapted to engage a wet concrete surface, and a receiver for removably receiving the lowermost end of the handle. A clamping and vibration transmitting arrangement is coupled externally to the lowermost end of the handle in spaced relationship from the working device. A vibratory mechanism is fixed to the clamping and vibration transmitting arrangement so that the vibrating mechanism is held in spaced relationship with the handle. The vibratory mechanism has a spinning crankshaft assembly with an eccentric weight mounted thereon, and an engine mounted in a housing for driving the spinning crankshaft assembly.

The clamping and vibration transmitting arrangement is removably secured to the lowermost end of the handle. The clamping and vibration transmitting arrangement includes a flat mounting plate secured to the engine housing, and a pair of clamps connected to opposite ends of the mounting plate and removably attached to a peripheral surface of the handle. An enclosure is joined to the engine housing, and the mounting plate is secured to the enclosure. The spinning crankshaft assembly includes a crankshaft driven by the engine and a rotating plate centrally attached to the crankshaft. The eccentric weight is mounted on the rotating plate offset from the crankshaft. The eccentric weight takes the form of a washer retained by a bolt threaded into the rotating plate. The enclosure surrounds the crankshaft, the rotating plate and the eccentric weight. The enclosure has a bottom opening covered by the mounting plate. Each of the clamps is comprised of a pair of mating U-shaped blocks removably joined together by a set of bolts. In the preferred embodiment, the working device is preferably a bull float.

In yet another aspect of the invention, a vibratory concrete finishing tool has an elongated handle removably coupled to a concrete working device at a lowermost end thereof. The invention is improved by a clamping and vibration transmitting arrangement coupled externally to the lowermost end of the handle in spaced relationship from the working device. A vibratory mechanism is fixed to the clamping and vibration transmitting arrangement so that the vibratory mechanism is held in spaced relationship with the handle. The vibratory mechanism has a spinning crankshaft assembly with an eccentric weight mounted thereon, and an engine mounted in a housing for driving the spinning crankshaft assembly so as to produce vibrational forces through the clamping and vibration transmitting arrangement to the handle and the concrete working device to enable finishing of a wet concrete surface.

Various other features, objects, and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
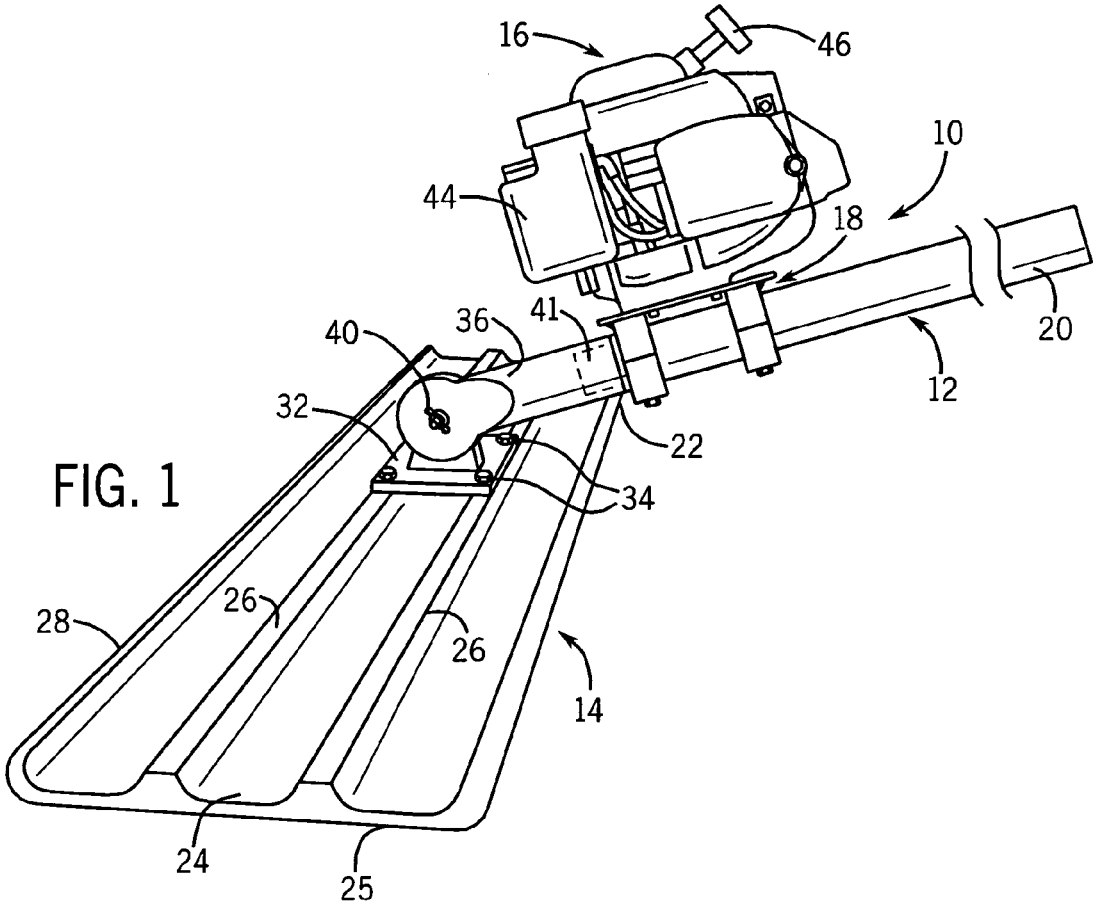
FIG. 1 is an elevational view of one side of a concrete finishing tool according to the present invention.
Figure 2:
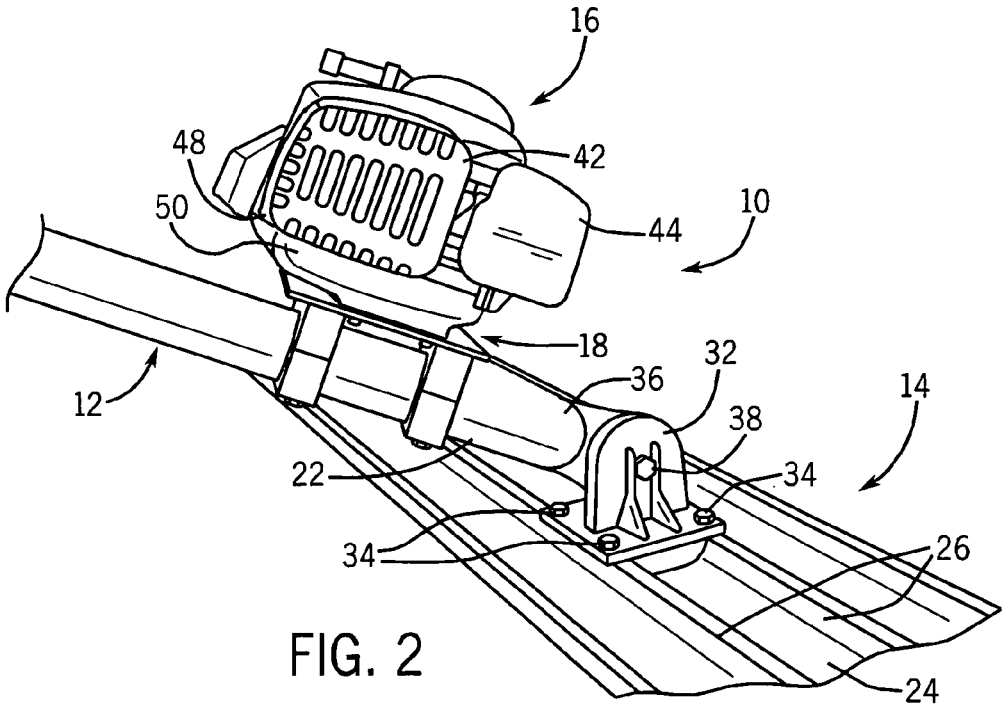
FIG. 2 is an elevational view of an opposite side of the concrete finishing tool in FIG. 1.
Figure 3:
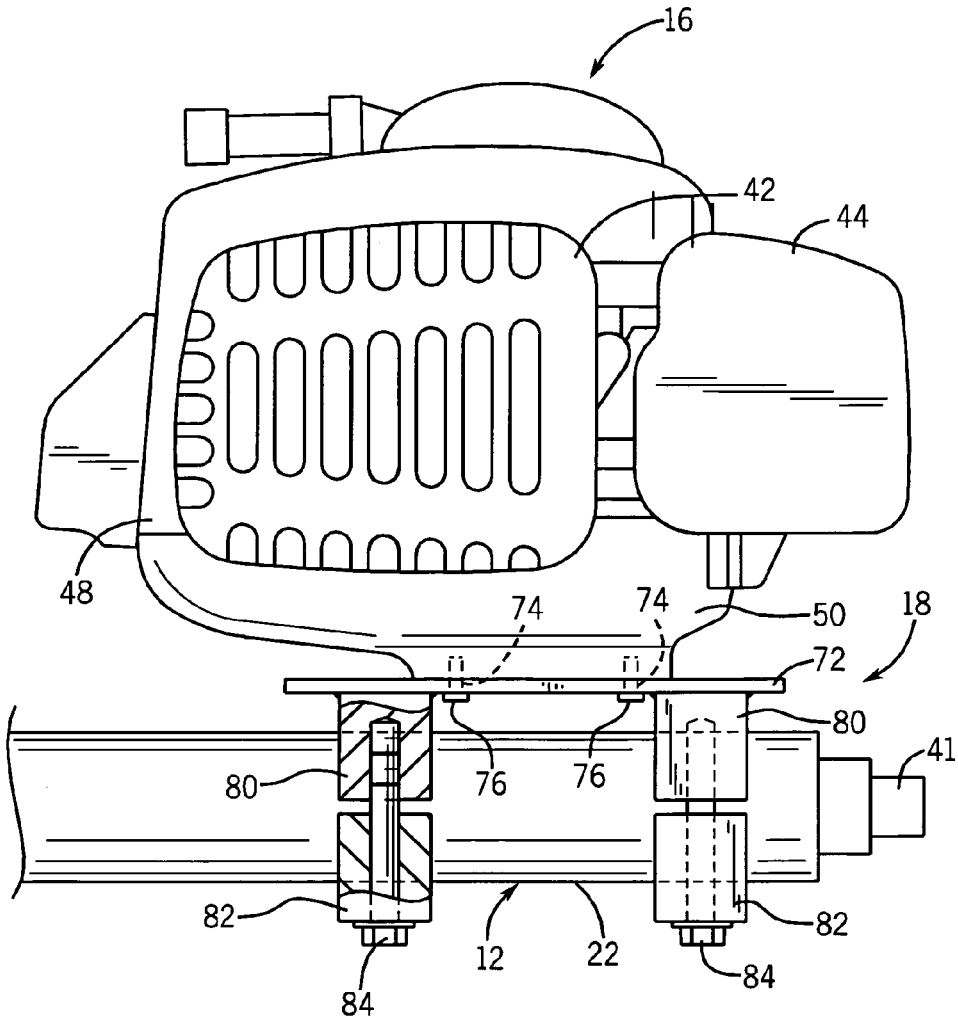
FIG. 3 is an enlarged view of the vibratory mechanism and clamping and vibration transmitting arrangement for the tool shown in FIG. 2.

Referring now to the drawings, FIGS. 1–5 disclose a preferred embodiment of the concrete finishing tool 10 embodying the present invention.

The concrete finishing tool 10 is generally comprised of an elongated handle 12, a concrete working device 14, a vibratory mechanism 16 and a clamping and vibration transmitting arrangement 18.

The elongated handle 12 has a cylindrical configuration and is typically formed by a number of aluminum or fiberglass sections which are coupled together in any suitable manner such as by cooperative screwthreaded engagement as is well known. The handle 12 is configured with a variable length having an uppermost end 20 and a lowermost end 22 to provide for the particular size of concrete slab to be finished. Handle 12 may be, for example, 20 feet long.

The concrete working device 14 preferably takes the form of a float, specifically a bull float, generally comprised of an aluminum or magnesium material. The bull float 14 is a large rectangular plate or blade 24 with a planar bottom surface 25 suitable to engage the wet concrete surface for a smoothing and finishing operation. Rigidity and stiffening of the bull float 14 is enhanced by ribs 26 running longitudinally along the top surface of the blade 24. Front and rear edges 28, 30 respectively, of the bull float 14 may be slightly rounded to prevent the edges from digging into and leaving marks in the wet concrete surface during floating. An upstanding bracket 32 is secured by fasteners 34 to the central upper portion of the bull float 14. A tubular receiver 36 is pivotally coupled by a pin 38 to the upstanding bracket 32. The angular position of the receiver 36 may be set by manipulating a wing nut 40 threaded on the pin 38. The lowermost end 22 of the handle 12 is removably coupled to the receiver 36. In the preferred embodiment, the male lower end 41 of the handle 12 is screwthreaded into a female end of the receiver 36. Other coupling arrangements are contemplated by the invention. For example, differently sized brackets and receivers may be used which utilize a spring pin to couple the handle 12 to the receiver 36. The angular position of the handle 12 relative to the bull float 14 is again conditioned upon the particular size of concrete slab to be finished. As will be appreciated hereafter, the working device 14 attached to the handle 12 may also take the form of an edger or final finishing tool such as a Fresno or trowel device comprised of thin steel or iron to seal the concrete surface.

In accordance with the present invention, the vibratory mechanism 16 is removably attached to the lowermost end 22 of the handle 12 by means of the clamping and vibration transmitting arrangement 18.

Figure 4:
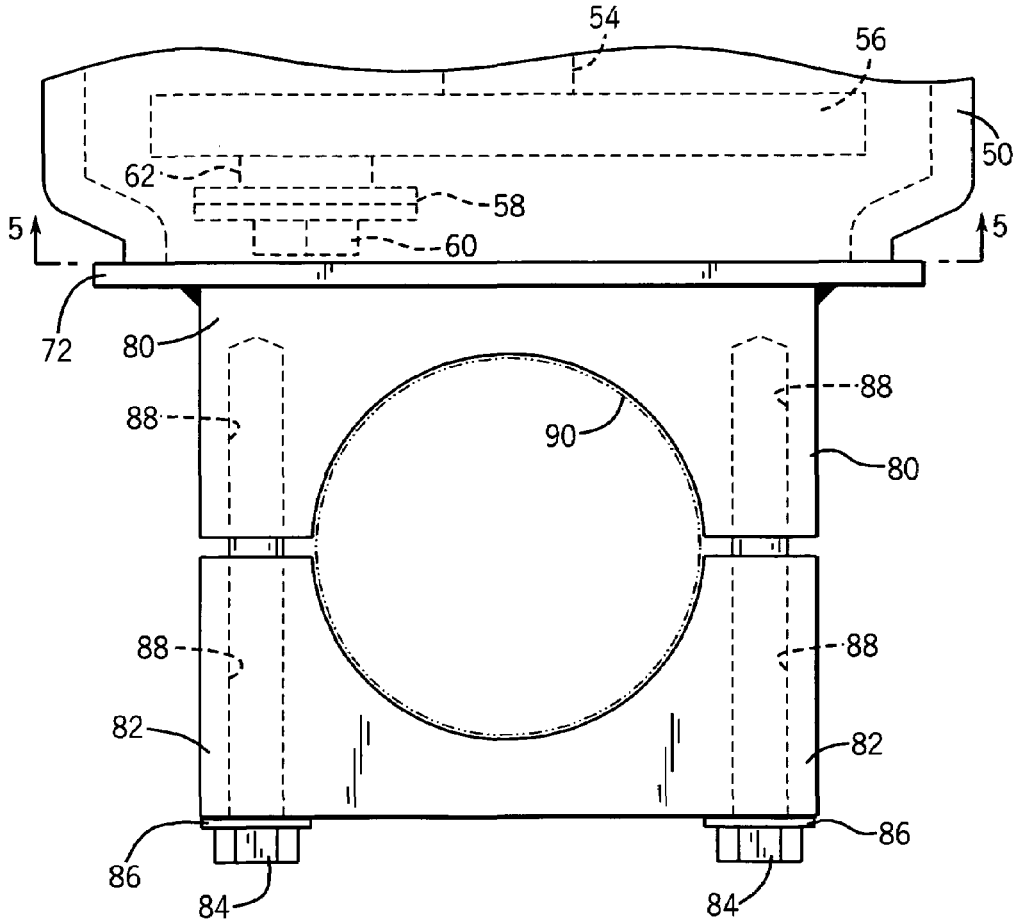
FIG. 4 is a view taken on line 4—4 of FIG. 1 with certain portions broken away.
Figure 5:
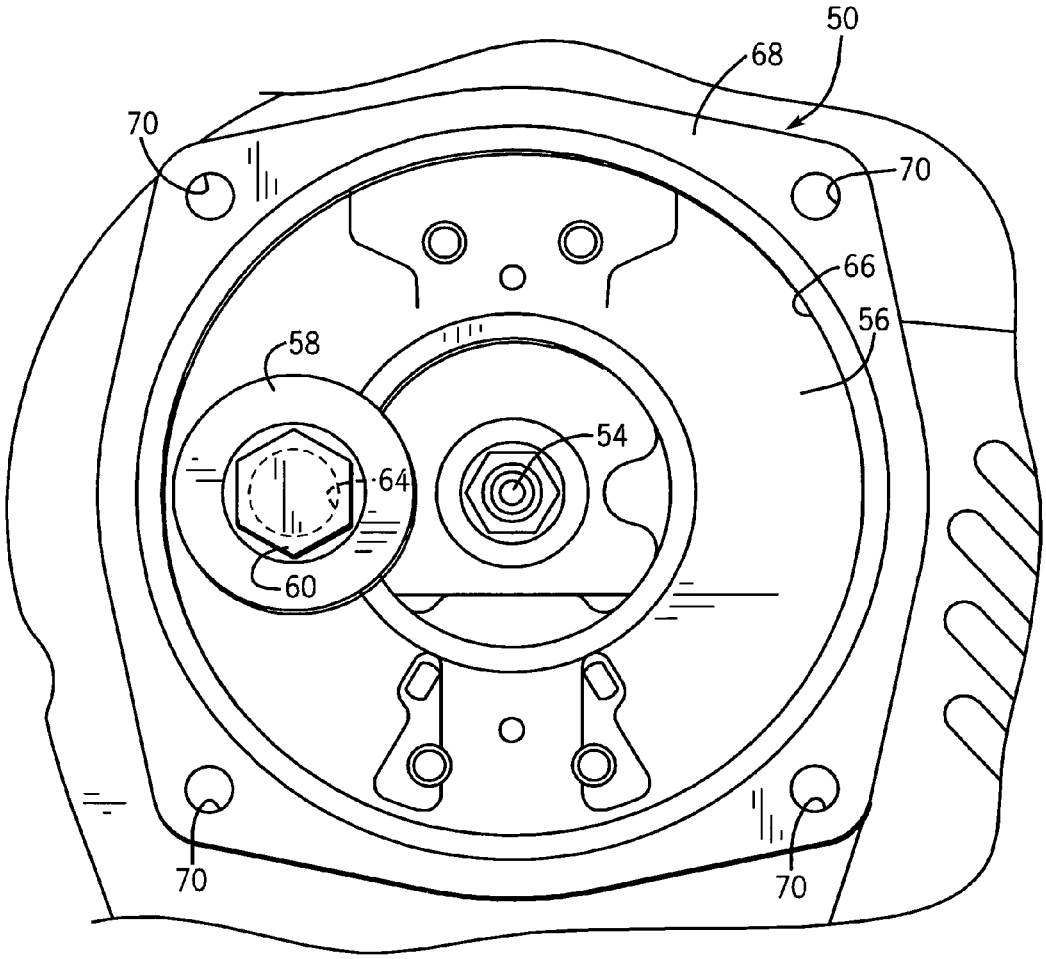
FIG. 5 is a bottom view of the spinning crankshaft assembly of the invention.

The vibratory mechanism 16 is basically a small "weedwacker" type two or four cycle, gasoline engine 42 which is commercially available from a number of manufacturers. The engine 42 typically includes a gas tank 44 and a start cord 46. As best seen in FIG. 4, the engine 42 has a housing 48, and an enclosure 50 removably connected to the housing 48, such as by a series of fasteners (not shown). The engine 42 has a spinning crankshaft 54 which is rigidly attached to a circular plate 56 (FIG. 5) driven for rotation about the axis of the crankshaft 54. The rotating plate 56 is provided with an eccentric weight, preferably in the form of a washer 58. The washer 58 is held in place by a bolt 60 having a shaft 62 which is threaded into an offset hole 64 formed in the rotating plate 56 in spaced relationship from the crankshaft 54. It should be understood that the enclosure 50 functions in part to surround and protect the crankshaft 54, rotating plate 56, and eccentric weight 58 during normal use. The enclosure 50 has an opening 66 on its bottom for providing access to the crankshaft 54, rotating plate 56 and eccentric weight 58. Such opening 66 is normally covered by the clamping and vibration transmitting arrangement 18 to be described below. The bottom of the enclosure 50 also has a depending wall 68 formed with a series of spaced apart threaded holes 70.

The clamping and vibration transmitting mechanism 18 includes a flat mounting plate 72 formed with a series of spaced apart apertures 74 that can be aligned with the threaded holes 70 in the enclosure 50. A series of bolts 76 provided with lock washers (not shown) are passed through the apertures 74, and threaded into the holes 70 to secure the mounting plate 72 to the enclosure 50 below the engine 42. A pair of U-shaped, block-type clamp halves 80 is welded or otherwise fixed to opposite ends of the mounting plate 72 outside the bolts 76. Each clamp half 80 has a mating clamp half 82, removably attached thereto by means of a set of bolts 84 which are passed through lock washers 86, and threaded into aligned bores 88 formed in the clamping halves 80, 82. The mating clamp halves 80, 82 have curved internal surfaces 90 suitably configured to firmly engage and clamp the peripheral surface of the handle 12 upon tightening of the bolts 84.

When assembled, the vibratory mechanism 16 and the clamping and vibrating transmitting mechanism 18 are removably mounted on the lowermost end of handle 12 at a position substantially rearwardly and above the concrete working device.

The concrete finishing tool 10 is used when pouring driveways, patios, basement floors, garage floors, porches, steps, etc. Following the striking process, the tool 10 operates to efficiently vibrate the freshly placed concrete so as to densify, redistribute and compact the poured mixture. A simple tug on the start cord 46 of the engine 42 provides vibration for effort-relaxed finishing. The vibration imparted by the tool 10 during the so-called floating process brings up the cream/paste from the redistributed mixture and fills in any voids encountered during the striking process. The clamping and vibration transmitting arrangement 18 simultaneously mounts the vibratory mechanism 16 strategically at the lowermost end 22 of the handle 12, and efficiently transmits the vibrations generated from the spinning eccentric weight 58 through the enclosure 50, the mounting plate 72, the clamp halves 80, 82 and bolts 84 to the bull float 14.

During the floating process, it is possible to uncouple the bull float 14 from the handle 12 and replace it with other working devices (not shown) such as an edger or a fine finishing tool comprised of steel or iron which is used to provide a final smoothing and seal the concrete surface. The versatility of the tool 10 is markedly enhanced by enabling various working devices to be interchangeably attached to the elongated handle 12 having the vibratory mechanism 16 externally mounted thereto at a point closest to the working device 14.

The present invention thus provides a highly efficient concrete finishing and leveling tool 10 for making the wet concrete surface free of bumps and waves and providing a smooth top surface finish. The vibration resulting from the tool automatically shakes the concrete beneath the float so that there may be less time spent striking than normal, and saves time and effort in traditional floating which results in faster finishing times with higher quality. Much less strain is imposed upon the finishing operator in the process. The concrete finishing tool 10 allows pours to be made at a lower slump (higher concrete stiffness) because the vibrating efficiency will maximize the amount of cream/paste that is available when using stiff mixes. Because the vibratory mechanism 16 and clamping and transmitting arrangement 18 weigh only several pounds, the tool 10 is lightweight and extremely portable and will not cause any marks to be left in the concrete surface. The tool 10 is relatively simple in structure, and can be economically manufactured and sold at a comparatively low price.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A vibratory concrete finishing tool comprising:

an elongated handle formed with a cylindrical configuration having an uppermost end and lowermost end;

a concrete working device having a planar bottom surface adapted to engage a wet concrete surface, and a receiver for removably receiving the lowermost end of the handle;

a clamping and vibration transmitting arrangement coupled externally to the lowermost end of the handle in spaced relationship from the working device; and a vibratory mechanism fixed to the clamping and vibration transmitting arrangement so that the vibratory mechanism is held in spaced relationship with the handle, the vibratory mechanism having a spinning crankshaft assembly with an eccentric weight mounted thereon, and an engine mounted in a housing for driving the spinning crankshaft assembly, wherein the clamping and vibration transmitting arrangement and the vibration mechanism are both spaced from and completely independent of the working device so that vibration is transmitted directly and exclusively through the handle to the working device.

2. The finishing tool of claim 1, wherein the clamping and vibration transmitting arrangement is removably secured to the lowermost end of the handle.

3. The finishing tool of claim 1, wherein the clamping and the vibration transmitting arrangement includes a flat mounting plate secured to the engine housing, and a pair of clamps connected to opposite ends of the mounting plate and removably attached to a peripheral surface of the handle.

4. The finishing tool of claim 3, wherein an enclosure is joined to the engine housing and the mounting plate is secured to the enclosure.

5. The finishing tool of claim 4, wherein the spinning crankshaft assembly includes a crankshaft driven by the engine, and a rotating plate centrally attached to the crankshaft.

6. The finishing tool of claim 5, wherein the eccentric weight is mounted on the rotating plate offset from the crankshaft.

7. The finishing tool of claim 5, wherein the eccentric weight takes the form of a washer retained by a bolt threaded into the rotating plate.

8. The finishing tool of claim 5, wherein the enclosure surrounds the crankshaft, the rotating plate and the eccentric weight.

9. The finishing tool of claim 4, wherein the enclosure has a bottom opening covered by the mounting plate.

10. The finishing tool of claim 3, wherein each of the clamps is comprised of a pair of mating U-shaped blocks removably joined together by a set of bolts, the blocks having curved internal surfaces engaged around the peripheral surface of the handle.

11. The finishing tool of claim 4, wherein the mounting plate is removably joined to the enclosure by another set of bolts.

12. The finishing tool of claim 1, wherein the working device is a bull float.

13. In a vibratory concrete finishing tool having an elongated handle removably coupled to concrete working device at a lowermost end thereof, the improvement comprising:

a clamping and vibration transmitting arrangement coupled externally to the lowermost end of the handle in spaced relationship from the working device; and a vibratory mechanism fixed to the clamping and vibration transmitting arrangement so that the vibratory mechanism is held in spaced relationship with the handle, the vibratory mechanism having a spinning crankshaft assembly including a rotating plate with an eccentric weight mounted thereon, and an engine mounted in a housing for driving the spinning crankshaft assembly so as to produce vibrational forces through the clamping and vibration transmitting arrangement to the handle and the concrete working device to enable finishing of a wet concrete surface, wherein the clamping and vibration transmitting arrangement and the vibratory mechanism are both spaced from and completely independent of the working device so that vibration is transmitted directly and exclusively through the handle to the working device.

14. The improvement of claim 13, wherein the clamping and vibration transmitting arrangement and the vibratory mechanism are positioned rearwardly and above the concrete working device.

15. A vibratory concrete finishing tool comprising:

an elongated handle formed with a cylindrical configuration having an uppermost end and lowermost end;

a concrete working device having a planar bottom surface adapted to engage a wet concrete surface, and a receiver for removably receiving the lowermost end of the handle;

a clamping and vibration transmitting arrangement coupled externally to the lowermost end of the handle in spaced relationship from the working device; and a vibratory mechanism fixed to the clamping and vibration transmitting arrangement so that the vibratory mechanism is held in spaced relationship with the handle, the vibratory mechanism having a spinning crankshaft assembly with an eccentric weight mounted thereon, and an engine mounted in a housing for driving the spinning crankshaft assembly, wherein the clamping and the vibration transmitting arrangement includes a flat mounting plate secured to the engine housing, and a pair of clamps connected to opposite ends of the mounting plate and removably attached to a peripheral surface of the handle, and wherein each of the clamps is comprised of a pair of mating U-shaped blocks removably joined together by a set of bolts, the blocks having curved internal surfaces engaged around the peripheral surface of the handle.

* * * * *